US005434598A

United States Patent [19]

Shimomine et al.

[11] Patent Number: 5,434,598

[45] Date of Patent: Jul. 18, 1995

[54] METHOD OF USING IMAGE RECEPTOR AND THERMAL TRANSFER SHEET

[75] Inventors: Akio Shimomine; Yasuo Tago, both of Osaka, Japan

[73] Assignee: Fujicopian Co. Ltd., Osaka, Japan

[21] Appl. No.: 261,049

[22] Filed: Jun. 14, 1994

Related U.S. Application Data

[62] Division of Ser. No. 54,026, Apr. 29, 1993, abandoned.

[30] Foreign Application Priority Data

Apr. 30, 1992 [JP] Japan ..... 4-111529

[51] Int. Cl.[6] ..... B41M 5/26

[52] U.S. Cl. ..... 347/217; 428/195; 428/207; 428/480; 428/484; 347/172

[58] Field of Search ..... 428/195, 207, 480, 484; 346/76 PH

[56] References Cited

U.S. PATENT DOCUMENTS 5,236,767 8/1993 Torigoe et al. ..... 428/480
5,283,115 2/1994 Shinohara ..... 428/195

FOREIGN PATENT DOCUMENTS

0283025A3 9/1988 European Pat. Off. .
0405248A3 1/1991 European Pat. Off. .
0454428A1 10/1991 European Pat. Off. .
62-13384 1/1987 Japan .
1-255589 10/1989 Japan .
2-150391 6/1990 Japan .
2-160589 6/1990 Japan .
3-58888 3/1991 Japan .

*Primary Examiner*—Pamela R. Schwartz
*Attorney, Agent, or Firm*—Adduci, Mastriani, Schaumberg, Meeks & Schill

[57] ABSTRACT

Provided is an image receptor for a thermal transfer ink, including a plastic film, and a coating layer which is formed on the plastic film and composed of a polyester resin of which glass transition point is 40° to 6.0° C., the amount of the coating layer when dried being 0.08 to 0.8 g/m$^2$. This image receptor is adaptable for a tape printer and assures good fixing property and fastness of a printed image while exhibiting a satisfactory anti-blocking property when stored. Also provided is a thermal transfer ink sheet for forming a printed image on the image receptor, including a sequential lamination of a foundation, a release layer, a barrier layer composed of a polyester resin, and a colored layer containing 40 to 60% by weight of a polyester resin and 30 to 60% by weight of a coloring agent. This thermal transfer ink sheet is advantageously used to form on the above image receptor a printed image of good fixing property and fastness.

1 Claim, No Drawings

METHOD OF USING IMAGE RECEPTOR AND THERMAL TRANSFER SHEET

This application is a division of application Ser. No. 08/054,026 filed Apr. 29, 1993 (now abandoned).

BACKGROUND OF THE INVENTION

The present invention relates to an image receptor and a thermal transfer ink sheet. More particularly, it relates to a thermal transfer ink image receptor which is advantageously used especially with a so-called "tape printer", and to a thermal transfer ink sheet which is advantageously used to form printed images on such an image receptor.

The above-noted tape printer is provided with simple word processing function and printing function, and adapted to form printed images while rewinding an image receptor in the form of a tape which is wound into a pancake-like body. A portion of the image receptor in which the printed images are formed is cut off and the cut piece is stuck onto an object. With the tape printer it is possible to form a heading-printed label, name-printed label and the like with ease.

A thermal transfer printer is usually employed in a printer part of the tape printer because it can be easily scaled down. Therefore, an ink sheet to be used therein is a thermal transfer ink sheet.

As the image receptor in the form of tape (hereinafter referred simply to as "image receptor") for use with such a tape printer, there is known an image receptor of the type wherein on one side of a foundation film such as polyester film is provided an image receiving layer such as made of a polyester resin which allows a thermal transfer ink to exhibit a good fixing property, and on the other side of the foundation film is provided a pressure-sensitive adhesive layer, on which a separator is further stacked (hereinafter referred to as "first prior art"). With this image receptor, an image is formed on the image receiving layer, the separator is then exfoliated, and that portion of the receptor tape in which the image is formed is stuck at its pressure-sensitive layer side on an object.

However, there arises a problem that if this image receptor is stored in the form of pancake, a blocking phenomenon is likely to occur such that the image receiving layer and the pressure-sensitive adhesive layer adhere to each other. Because of the blocking phenomenon, the image receptor becomes hard to be rewound, or even if it can be rewound, the image-receiving side thereof may be soiled or damaged.

The blocking will not occur if the pressure-sensitive adhesive layer is covered with a separator of which both sides are imparted with a releasing property using, for example, a silicone resin. With such a separator, however, when an image receptor body consisting of a foundation provided with an image receiving layer and a separator are wound around a core in the production of the image receptor, the wound receptor is likely to come out of the core because slipping is excessive between the surface of the image receiving layer and that of the separator.

For this reason the first prior art uses a separator of which only the side in contact with the pressure-sensitive adhesive layer is imparted with a releasing property. Therefore, the first prior art is poor in anti-blocking property.

Such a poor anti-blocking property can be significantly improved if the glass transition point of the polyester resin used in the image receiving layer is raised. However, there appears a drawback that the polyester resin of a raised glass transition point degrades the fixing property of the thermal transfer ink.

With the first prior art, in addition, since the printed image on the image receiving layer is exposed, the fastness (against abrasion, alcohol and the like) of the printed image is poor.

As an alternative prior art, there is known an art (hereinafter referred to as "second prior art") wherein printed images are formed on one side of a transparent tape of plastic film, and an adhesive double coated tape which is usually colored is stuck on the side having the printed images so as to allow sticking of the transparent tape on an object.

With the second prior art, although the printed image is superior in fastness by virtue of protection with the transparent film, a step is needed to stack the adhesive double coated tape over the printed image, which entails a problem that the device according to the second prior art cannot be simplified or reduced in size. Therefore, this prior art is not preferable.

It is an object of the present invention to overcome the problems involved in the aforesaid first prior art by providing an image receptor for a thermal transfer ink which enhances the fixing property of the thermal transfer ink and exhibits a satisfactory anti-blocking property while, at the same time, assuring a printed image of good fastness though exposed, and by providing a thermal transfer ink sheet which is advantageously used to form on such an image receptor a printed image of good fixing property and fastness.

This and other objects of the invention will become apparent from the description hereinafter.

SUMMARY OF THE INVENTION

According to the present invention, there is provided an image receptor for a thermal transfer ink comprising; a plastic film, and a coating layer which is disposed on the plastic film and comprises a polyester resin of which glass transition point is 40° to 60° C., the amount of the coating layer when dried being 0.08 to 0.8 g/m$^2$.

According to the present invention, there is also provided a thermal transfer ink sheet for forming a printed image on the above image receptor, comprising a foundation, a release layer disposed on the foundation, a barrier layer disposed on the release layer and comprising a polyester resin, and a colored layer disposed on the barrier layer and containing 40 to 60% by weight of a polyester resin and 30 to 60% by weight of a coloring agent.

DETAILED DESCRIPTION

First, the image receptor according to the present invention will be described.

The image receptor according to the present invention includes a plastic film and a coating layer which is formed on the plastic film and composed of a polyester resin of which glass transition point is 40° to 60° C., the amount of the coating layer when dried being 0.08 to 0.8 g/m$^2$. The coating layer will hereinafter be referred to as "image receiving layer".

In the present invention the polyester resin of such a low glass transition point is used for the image receptor. This enhances the fixing property of a printed image of a thermal transfer ink and, in turn, the enhanced fixing property strengthens the fastness of the printed image, for example, against abrasion.

Furthermore, despite the use of the polyester resin of such a low glass transition point for the image receiving layer, an unexpected effect such as to improve the anti-blocking property is offered by reducing the coating amount of the image receiving layer to a small value, as small as 0.08 to 0.8 g/m$^2$. Although the reason for this effect is not determined yet, it is presumed as follows. The plastic film as used in the present invention in general is incorporated with particles so as to rough the surface thereof and, thus, the particles project from the surface. In addition, the plastic film per se do not necessarily have an even surface but a rough surface. For such reasons, when the plastic film is coated with the polyester resin of which amount is smaller than a specific value, the contact area between the image receiving layer and the back of the foundation becomes small, thus improving the anti-blocking property. On the contrary, coating of the polyester resin in an amount larger than the specific value buries the particles and unevenness completely, so that the surface of the image receiving layer is made even or smooth. As a result, the image receiving layer and the back of the foundation come into full contact with each other, which degrades the anti-blocking property.

In the image receptor according to the present invention, as the plastic film constituting the foundation there is preferably used a polyester film such as a polyethylene terephthalate film, allowing for its favorable strength, adhesiveness with the image receiving layer and the like. Alternatively, usable are a polyvinyl chloride film, polycarbonate film, triacetyl cellulose film, polyamide film, polyimide film, aramid film and the like. The thickness of the foundation is preferably from about 20 to about 150 μm, more preferably from about 100 to about 150 μm allowing for the handling property in sticking on an object.

The image receiving layer is a coating layer mainly composed of a polyester resin. The polyester resin used for the image receiving layer is a linear saturated polyester resin which is obtained by allowing a dicarboxylic acid component (usually containing an aliphatic dicarboxylic acid as a main ingredient together with an optional ingredient such as an aromatic dicarboxylic acid or an alicyclic dicarboxylic acid) to react with a diol component (usually containing an alkylene glycol as a main ingredient together with an optional ingredient such as polyalkylene glycol).

The above polyester resin needs to have a glass transition point of 40° to 60° C. The glass transition point higher than that range results in a printed image with a poor fixing property, hence, with a poor resistance against abrasion. On the other hand, the glass transition point lower than the range causes the anti-blocking (storage) property to degrade.

Preferable as the polyester resin are those having a molecular weight (number average molecular weight, hereinafter the same) of $8\times10^3$ to $3\times10^4$. When the molecular weight thereof is less than that range, the fastness, such as the resistance against alcohol, of a printed image tends to degrade. On the other hand, when it is larger than the range, the fixing property of a printed image becomes poor and, hence, the fastness thereof tends to degrade.

The image receiving layer may incorporate, besides the above polyester resin, a small amount of another resin such as a melamine resin, or of an extender such as silica or titanium oxide.

The coating amount of the image receiving layer needs to be within the range of 0.08 to 0.8 g/m$^2$. When it is larger than that range, the blocking property degrades. When it is less than the range, the fixing property degrades.

The image receiving layer can be formed by applying a solution of the polyester resin in a solvent onto thee foundation film, followed by drying.

A colored coating layer may be provided on the foundation at the side not formed with the image receiving layer. Instead of the provision of the colored coating layer, a colored foundation may be used.

A pressure-sensitive adhesive layer is formed on the foundation at the side not formed with the image receiving layer. As the pressure-sensitive adhesive layer, a conventionally known one can be used without any particular limitation. A separator is stacked on the pressure-sensitive adhesive layer. As the separator, a common release paper is used of which one side is imparted with releasing property. A release paper of which both sides are imparted with releasing property is not preferable because it causes the image receptor in a wound condition to come out of the core.

To be described next is the thermal transfer ink sheet according to the present invention.

In the thermal transfer ink sheet according to the present invention a colored layer is provided on a foundation with a release layer sandwiched therebetween. The colored layer contains 40 to 60% (% by weight, hereinafter the same) of a polyester resin and 30 to 60% of a coloring agent.

As with the image receiving layer, a polyester resin is used as a main ingredient of a vehicle contained in the colored layer in order to form a printed image with a good fixing property on the aforesaid image receptor. To improve the fastness (resistance against abrasion, alcohol and the like) of the obtained printed image, the content of the polyester resin is considerably large, as large as 40 to 60%. Since the polyester resin is contained in such a large amount, a large content, as large as 30 to 60%, of the coloring agent is needed to enhance the selective transferability of the colored layer. If the content of the polyester resin is less than that range, a printed image is obtained with degraded fixing property and fastness, whereas if it is larger than the range, the selective transferability of the colored layer degrades. Alternatively, if the content of the coloring agent is less than the range, the selective transferability of the colored layer degrades, whereas if it is larger than the range, the colored layer becomes too weak or brittle and, hence, the fastness of a printed image also degrades.

As the polyester resin for use in the colored layer, usable are polyester resins similar to those used in the image receiving layer. Among these, preferable are those having a glass transition point of 45° to 80° C. and a molecular weight of $5\times10^3$ to $2\times10^4$. The glass transition point higher than that range results in degraded selective tranferability and fixing property, while that which is lower than the range degrades the anti-blocking property of the ink sheet. The molecular weight less than the above-noted range results in degraded fastness despite an improvement in the selective transferability of the colored layer, while that which is larger than the range degrades the selective transferability of the colored layer despite excellent fastness thereof.

The coloring agent is appropriately selected from various organic or inorganic pigments such as carbon black, and dyes.

Besides the above-noted ingredients, the colored layer may incorporate an additive such as a dispersant or extender (titanium oxide etc.).

The release layer is composed of a wax substance, and may incorporate a resin in order to improve the clearness of a printed image (selective transferability of the transfer layer) or to avoid release of the colored layer under the normal conditions.

Examples of the wax substance include animal or vegetable waxes such as carnauba wax and bees wax; petroleum waxes such as paraffin wax and microcrystalline wax; and synthetic waxes such as oxidized wax, ester wax, low molecular weight polyethylene wax and α-olefin-maleic anhydride copolymer wax. Examples of the resin include ethylene-vinyl acetate copolymers, ethylene-ethyl acrylate copolymers, vinyl acetate resins, terpene resins and petroleum resins. Where the resin is used, it is used preferably in an amount of 1 to 50 parts (part by weight, hereinafter the same) relative to 100 parts of the wax substance.

In the present invention the fastness of a printed image can be further improved by providing a barrier layer between the aforesaid release layer and the colored layer. The barrier layer becomes the top layer of an image printed on the image receiving layer and serves to protect it.

The barrier layer is preferably composed of a polyester resin as with the colored layer, so as to improve the affinity therewith. Although a faint amount of an additive can be incorporated, the barrier layer is preferably composed of the polyester resin alone. As the polyester resin, usable are polyester resins similar to those in the colored layer.

The thermal transfer ink sheet according to the present invention can be produced by sequentially stacking on an appropriate foundation the release layer, barrier layer anti colored layer. Each of these layers is formed by dispersing or dissolving a composition for the corresponding layer in an appropriate solvent to give a coating liquid, applying the coating liquid, and drying it. The release layer may be formed by hot melt coating. The amounts of the release layer, barrier layer and colored layer when dried are suitably 0.2 to 1.0 g/m$^2$, 0.2 to 0.8 g/m$^2$, and 0.3 to 1.5 g/m$^2$, respectively.

As the foundation, any of the foundations used in conventional thermal transfer ink sheets can be used.

The present invention will be more specifically described by way of Examples and Comparative Example. It is to be understood that the present invention is not limited to the Examples, and various change and modifications may be made in the invention without departing from the spirit and scope thereof.

EXAMPLES 1 TO 4 AND COMPARATIVE EXAMPLE

Fabrication of Image Receptor

On one side of a 120 μm-thick polyethylene terephthalate film was applied a 5% solution of a polyester resin (UE-3210, a product of UNITIKA Ltd., glass transition point: 45° C., molecular weight: 20,000) in a toluene-methyl ethyl ketone mixed solvent (2:3 in weight ratio), followed by drying to form an image receiving layer. The amount of the solution when dried was as shown in Table 1.

On the other side of the film was formed a 15 μm-thick pressure-sensitive adhesive layer of an acrylic resin type, on which a separator imparted with releasing property at one side thereof was stacked so that the the releasing side would be brought into contact with the adhesive layer. The separator was a release paper wherein one side of a glassine paper was imparted with releasing property using a silicone resin.

EXAMPLE 5

Fabrication of Thermal Transfer Ink Sheet

On one side of a 6 μm-thick polyethylene terephthalate film was applied a coating solution, followed by drying to form a release layer, the amount of which was 0.4 g/m$^2$ after drying. The coating solution was previously prepared by dissolving 100 parts of the following composition for the release layer in a mixed solvent of 1,100 parts of toluene and 470 parts of isopropyl alcohol.

| INGREDIENT | PART |
|---|---|
| DIACARNA 30B (produced by MITSUBISHI KASEI CO., α-olefin-maleic anhydride copolymer wax) | 8 |
| Polyethylene wax | 59 |
| Ethylene-vinyl acetate copolymer | 33 |

On the above release layer was applied a coating solution of 100 parts of a polyester resin (XA-4041, a product of UNITIKA Ltd., glass transition point: 52° C., molecular weight: 7,000) in a mixed solvent of 628 parts of toluene and 942 parts of methyl ethyl ketone, followed by drying to form a barrier layer, the amount of which was 0.4 g/m$^2$ after drying.

On the thus formed barrier layer was applied a coating liquid, followed by drying to form a colored layer, the amount of which was 0.8 g/m$^2$ after drying. The coating liquid was previously prepared by dissolving or dispersing 100 parts of the following composition for the colored layer in a mixed solvent of 140 parts of toluene and 210 parts of methyl ethyl ketone.

| INGREDIENT | PART |
|---|---|
| Polyester resin (XA-4041) | 47 |
| Dispersant (HOMOGENOL L-18, a product of DAI-ICHI KOGYO SEIYAKU CO., LTD.) | 6 |
| Carbon black | 47 |

Each of the image receptors fabricated in Examples 1 to 4 and Comparative Example was wound around a core while being slitted to have a width of 9 mm, to form a pancake-like image receptor sample. Upon winding, any of the image receptors did not come out of the core.

On the other hand, the thermal transfer ink sheet was wound around a core while being slitted to have a width of 9 mm, to form a pancake-like ink sheet sample.

The thus formed image receptor sample and ink sheet sample were set on a commercially-available tape printer. With such a tape printer, printing was carried out while the receptor image and ink sheet were rewound. The printed portion was cut off, and stuck to a plastic plate with the separator thereof exfoliated. Print samples thus obtained were evaluated for the resistance against rubber eraser and the resistance against alcohol. In addition, the image receptor sample was examined for its anti-blocking property.

(1) Resistance against rubber eraser

A rubber eraser (15 mm×15 mm×10 mm) was pressed against the printed surface at 1.8 kgf and reciprocated 100 times with use of a rubbing tester (Rub Tester made by Yasuda Seiki Kabushiki Kaisha). Erasing or abrasion of the thus treated printed image was rated into the following four stages:

4 . . . printed image with no erasing or abrasion

3 . . . printed image with partial erasing or abrasion

2 . . . printed image with significant erasing or abrasion but legible

1 . . . printed image substantially completely erased, and illegible (2) Resistance against alcohol A cotton fabric cloth soaked with ethyl alcohol was pressed against the printed surface and reciprocated 50 times with use of a crock meter made by AATCC CO. Erasing or abrasion of the thus treated printed image was rated into the following four stages:

4 . . . printed image with no erasing or abrasion

3 . . . printed image with partial erasing or abrasion

2 . . . printed image with significant erasing or abrasion but legible

1 . . . printed image substantially completely erased, and illegible (3) Anti-blocking property The above pancake-like image receptor sample was allowed to stand at 55° C. for 48 hrs., then rewound. The easiness for rewinding and the superficial condition of the image receiving layer were observed, and rated into the following four stages:

4 . . . smooth rewinding with no adhesion between the image receiving layer and the separator, and no superficial change of the image receiving layer

3 . . . smooth rewinding with no adhesion between the image receiving layer and the separator, but the image receiving layer superficially traced with fibers of the separator

2 . . . rewinding enabled despite adhesion between the image receiving layer and the separator, but the image receiving layer superficially traced with fibers of the separator

1 . . . difficult rewinding with adhesion between the image receiving layer and the separator, and if rewound by forces, the image receiving layer attached at its surface with fibers of the separator.

The results of the above experiments are as shown in Table 1.

TABLE 1

| Image Receptor | Ex. 1 | Ex. 2 | Ex. 3 | Ex. 4 | Comp. Ex. |
|---|---|---|---|---|---|
| Amount of image receiving layer (g/m$^2$) | 0.1 | 0.2 | 0.4 | 0.6 | 1.0 |
| Resistance against rubber eraser | 4 | 4 | 4 | 4 | 4 |
| Resistance against alcohol | 3 | 4 | 4 | 4 | 4 |
| Anti-blocking property | 4 | 4 | 3 | 3 | 2 |

As can be clearly understood from the foregoing, the image receptor according to the present invention favorably enhances the fixing property and fastness of a printed image while exhibiting satisfactory anti-blocking property when stored.

Also, the thermal transfer ink sheet according to the present invention enables to give a printed image with good fixing property and fastness on the above image receptor.

In addition to the materials and ingredients used in the Example, other materials and ingredients can be used in the Example as set forth in the specification to obtain substantially the same results.

What is claimed is:

1. A process for forming a printed image on an image receptor comprising the steps of:

providing a thermal transfer ink sheet comprising a foundation, a release layer disposed on the foundation, a barrier layer disposed on the release layer and consisting essentially of a polyester resin, and a colored layer disposed on the barrier layer and containing 40 to 60% by weight of a polyester resin and 30 to 60% by weight of a coloring agent, wherein the polyester resin in the colored layer has a glass transition point of 45° to 80° C. and the polyester resin in the barrier layer has a glass transition point of 45° to 80° C., and an image receptor comprising a plastic film, and a coating layer disposed on the plastic film and comprising a polyester resin of which the glass transition point is 40° to 60° C., the amount of the coating layer when dried being 0.08 to 0.8 g/m$^2$, and thermally transferring the colored layer of the thermal transfer ink sheet together with the barrier layer thereof to form a printed image on the coating layer of the image receptor.

* * * * *